US006408542B1

(12) United States Patent
Shepherd

(10) Patent No.: US 6,408,542 B1
(45) Date of Patent: Jun. 25, 2002

(54) PADDED SHOE

(75) Inventor: Stephen H. Shepherd, West Palm Beach, FL (US)

(73) Assignee: Ringstar, Inc., New Albany, OH (US)

( * ) Notice: Subject to any disclaimer, the term of this patent is extended or adjusted under 35 U.S.C. 154(b) by 0 days.

(21) Appl. No.: 09/593,256

(22) Filed: Jun. 13, 2000

Related U.S. Application Data

(60) Provisional application No. 60/165,548, filed on Nov. 15, 1999.

(51) Int. Cl.[7] ..... A43B 23/26; A43B 13/14; A43B 5/00

(52) U.S. Cl. ..... 36/54; 36/99; 36/71; 36/72 R; 36/114

(58) Field of Search ..... 36/50.1, 54, 55, 36/71, 72 R, 133, 99, 93, 114

(56) References Cited

U.S. PATENT DOCUMENTS

| | | | |
|---|---|---|---|
| 3,379,722 | A | 4/1968 | Manson et al. |
| RE27,512 | E | 10/1972 | Onitsuka |
| 3,949,493 | A | 4/1976 | Rhee |
| 4,051,613 | A | 10/1977 | Collins |
| 4,361,970 | A | 12/1982 | Wren, Jr. et al. |
| 4,495,715 | A | 1/1985 | Fredrickson et al. |
| 4,547,981 | A | 10/1985 | Thais et al. |
| 4,624,015 | A | 11/1986 | Bottoms |
| 4,769,928 | A | 9/1988 | Ward |
| 4,972,609 | A | 11/1990 | Oh et al. |
| 5,117,568 | A | 6/1992 | Mitsui |
| 5,211,672 | A | 5/1993 | Andujar |
| 5,430,960 | A | 7/1995 | Richardson |

*Primary Examiner*—M. D. Patterson
(74) *Attorney, Agent, or Firm*—Akerman Senterfitt

(57) ABSTRACT

A padded shoe includes a shoe upper which is adjoined to a sole. The shoe upper and the sole can have padding material disposed therein. The shoe upper includes a padded tongue, which can have an inner tongue portion and an outer tongue portion. A fastening structure, which can be tightenable to maintain the shoe on the foot of the wearer, can be disposed between the inner and outer tongue portions. Alternatively, a resilient portion can be connected to the shoe upper, whereby a portion of the shoe upper can be outwardly distended to allow insertion of the foot of the wearer. The shoe can include an engagement structure to secure the outer tongue portion to at least one of the inner tongue portion and the shoe upper.

21 Claims, 8 Drawing Sheets

PADDED SHOE

CROSS REFERENCE TO RELATED APPLICATIONS

This application claims the benefit of U.S. Patent Provisional Application No. 60/165,548, filed on Nov. 15, 1999.

STATEMENT REGARDING FEDERALLY SPONSORED RESEARCH OR DEVELOPMENT (Not Applicable)

BACKGROUND OF THE INVENTION

1. Field of the Invention

The present invention relates to footwear, and more particularly to a shoe designed for use in athletic activities.

2. Description of the Related Art

The foot can be subjected to stresses during athletic activities. Existing athletic shoes, such as those disclosed by Thais et al., U.S. Pat. No. 4,547,981, Richardson, U.S. Pat. No. 5,430,960, Onitsuka, U.S. Pat. No. Re. 27,512, and Mitsui, U.S. Pat. No. 5,117,568, are primarily constructed to provide support for the instep and ankles of the wearer while running or jumping. In addition to running and jumping, some sports and fitness activities require the participant to engage in kicking maneuvers, such as martial arts and soccer. The top, sides, sole, and heel of the feet can sustain severe blows during such activities. Additionally, kicks can be landed against another person during certain activities, either inadvertently or, in the case of the martial arts, while sparring. There is a possibility that the impact of knotted shoe laces or other shoe fastening structure can injure the participants during athletic activities such as sparring. It is therefore desirable to provide a shoe which protects from such injuries during activities such as martial arts, kick boxing, and soccer.

Prior art shoes adapted to prevent injury from kicking are generally those designed specifically for use in the martial arts. Such shoes are known to have significant limitations. For example, such shoes generally do not have a shoe lacing arrangement. As a lacing arrangement often provides the greatest degree of support for the ankle of the wearer, prior art martial arts shoes generally do not have the ankle support that is found in many athletic shoes. In addition, conventional martial arts shoes are generally not suitable for street wear.

Another limitation of conventional shoes for use in activities involving kicking, such as soccer, kick boxing, and martial arts, involves the padding used throughout the shoe. For example, martial arts shoes disclosed in Oh et al., U.S. Pat. No. 4,972,609, Frederickson et al., U.S. Pat. No. 4,495,715, Wren, Jr., et al., U.S. Pat. No. 4,361,970, and Rhee, U.S. Pat. No. 3,379,722 disclose foot protectors which are little more than foam pads strapped to the foot.

Andujar, U.S. Pat. No. 5,211,672 (Andujar), discloses a protective shoe for use in contact sports such as martial arts. In Andujar, the shoe upper is constructed of foam, and includes additional protective pads on its ankle and top portions. The shoe is secured by a single elastic strap held in place by Velcro® fasteners. This fastening system would not provide a significant amount of support to the ankles of the wearer, and could easily slip and become displaced, causing the wearer to become unbalanced. Collins, U.S. Pat. No. 4,051,613, similarly discloses a padded boot for use in the martial arts. This shoe is also secured by a single elastic strap with Velcro® fasteners.

Rhee, U.S. Pat. No. 3,949,493, discloses a protective shoe constructed of energy absorbing resilient material and a substantially open bottom. The open bottom allows the foot of the wearer to contact the floor or the ground. The shoe designed by Rhee is for use only in a gym or sparring ring, and is obviously unsuitable for everyday wear.

Bottoms, U.S. Pat. No. 4,624,015, discloses a karate and kickboxing protective boot which has an open back and a detachable heel protector portion. This boot is designed strictly for use in a sparring ring.

Ward, U.S. Pat. No. 4,769,928, discloses a slip-on type shoe for use in the martial arts. This shoe is constructed of a lightly padded material. Ward does not disclose the use of heavy padding positioned on the foot so as to absorb the impact of a kick against a kicking bag or opponent.

It would be advantageous to provide a shoe which is adapted for activities involving kicking that can protect a wearer of the shoe and/or a partner from injury, while also providing ankle support to the wearer.

SUMMARY OF THE INVENTION

A padded shoe, according to an embodiment of the invention, includes a shoe upper which is adjoined to a sole. The shoe upper includes padding material disposed therein, which can be closed-cell foam padding. The sole of the shoe can have a smooth lower surface or a textured lower surface, and can also include a plurality of gripping protrusions. The shoe upper includes a padded tongue having an inner tongue portion and an outer tongue portion. The inner and outer tongue portions can each have a lower end attached to the shoe upper and a free upper end. A fastening structure, which is tightenable to maintain the shoe on the foot of the wearer is disposed between the inner and outer tongue portions. The shoe includes an engagement structure to secure the outer tongue portion to at least one of the inner tongue portion and the shoe upper. When a wearer of the padded shoe strikes a target with the padded tongue, the target and/or the wearer are protected from direct impact with the fastening structure.

The padding within the shoe upper can be positioned within the shoe upper to generally correspond to at least one of the following locations on the foot of the wearer: the forward dorsal region, the instep, the posterior aspect of the heel, the left and right forward lateral aspects of the foot, and the ankle portion. At least a portion of the perimeter of the shoe can be chamfered to provide a smooth arcuate edge. The sole can be formed at least partially from crepe rubber.

The fastening structure can include a lace threaded through oppositely disposed eyelets. The engagement structure can include mated snaps or mated portions of hook and loop fastening material. The shoe upper can extend at least to the ankle of the wear, and the padded tongue can extend above the shoe upper.

A second embodiment of the shoe, according to the invention, can include a shoe upper which is adjoined to a sole. The shoe upper includes padding disposed therein, which can be closed-cell foam padding. The shoe upper can include a padded tongue having side edges, and one or more resilient portions. The resilient portions can have a first edge adjoined to the side edges of the padded tongue and a second edge adjoined to the shoe upper. The resilient portions allow a portion of the shoe upper to be outwardly distended to allow the insertion of the foot of the wearer. The foam padding can be positioned within the shoe upper to generally correspond to at least one of the following locations on the foot of the wearer: the forward dorsal region, the instep, the lateral and posterior aspects of the heel, the left and right forward lateral aspects of the foot, and the ankle portion. The sole can have a smooth or a textured lower surface, and can include a plurality of gripping protrusions. At least a portion of the perimeter of the sole can be chamfered. The sole can be formed at least partially from crepe rubber.

A third embodiment of the shoe includes a shoe upper adjoined to a sole. The shoe upper includes padding material therein, which can be closed-cell foam padding. The shoe can include a padded tongue having a first end attached to the shoe upper and a second free end. The sole of the shoe can have a smooth lower surface or a textured lower surface, and can also include a plurality of gripping protrusions. In addition, the sole can be formed at least partially from crepe rubber. The padding material can be positioned within the shoe upper to generally correspond to at least one of the following locations on the foot of the wearer: the forward dorsal region, the instep, the lateral and posterior aspects of the heel, the left and right forward lateral aspects of the foot, and the ankle portion.

The shoe can further include a shin guard detachably connected to the padded tongue. The shin guard preferably has a convex front surface and a concave rear surface, and extends upwardly from the shoe to be in contact with the shin of the wearer. The shin guard can be configured to closely engage with the shin of the wearer. The shoe can further include at least one strap connected to the elongate member to secure the shin guard to the lower leg of the wearer. The strap can include a fastening structure. The shoe can include an engagement structure to secure the elongate member to the padded tongue. The shin guard can comprise portions of hook and loop fastening material, or mated snaps. The shin guard can include padding disposed therein. The front surface of the elongate member can include a recess approximately the same width of the strap which is adapted to receive the strap when the shin guard is secured to the lower leg of the wearer.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

Figure 1:
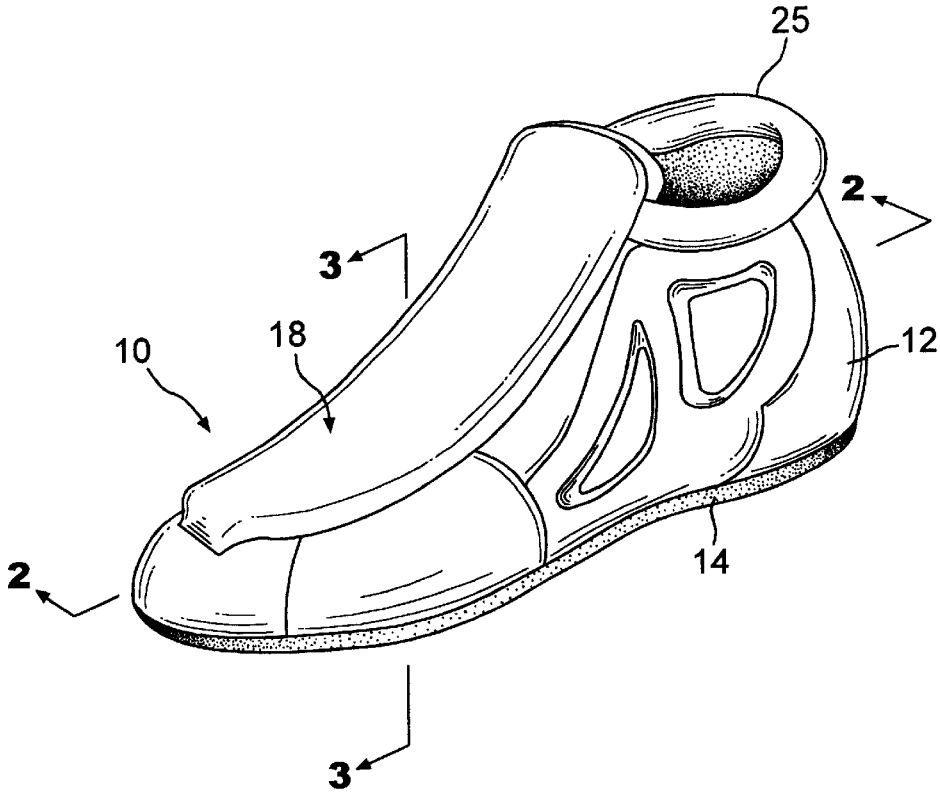
FIG. 1 is a perspective view of a padded shoe according to an embodiment of the invention.

A shoe 10 according to a preferred embodiment of the invention is illustrated in FIG. 1. The shoe 10 is preferably formed of materials which are light in weight yet still strong and durable. The shoe 10 includes a shoe upper 12 adjoined to a sole 14. The shoe upper 12 can be manufactured from any conventional material such as leather, synthetic leather, or canvas. The shoe upper 12 preferably extends at least to the ankle of the wearer, however, the invention is not limited in that regard. For example, the shoe upper 12 can extend significantly beyond the ankle of the wearer to cover all or a portion of the skin, or not extend to the ankle of the wearer. The upper edge 25 of the shoe upper 12 preferably forms a collar into which a foot can be inserted.

A portion of the edge of sole 14 can be chamfered to provide a continuous arcuate edge at the point where the sole 14 is joined to the shoe upper 12. It is particularly preferable to have chamfered edges at the front toe and rear heel portions of the shoe 10. The sole 14 can be attached to the shoe upper 12 by any means known in the art, such as gluing, stitching, or heat sealing. The shoe upper 10 preferably includes a padded tongue 18, to be discussed in detail hereinafter.

Figure 2:
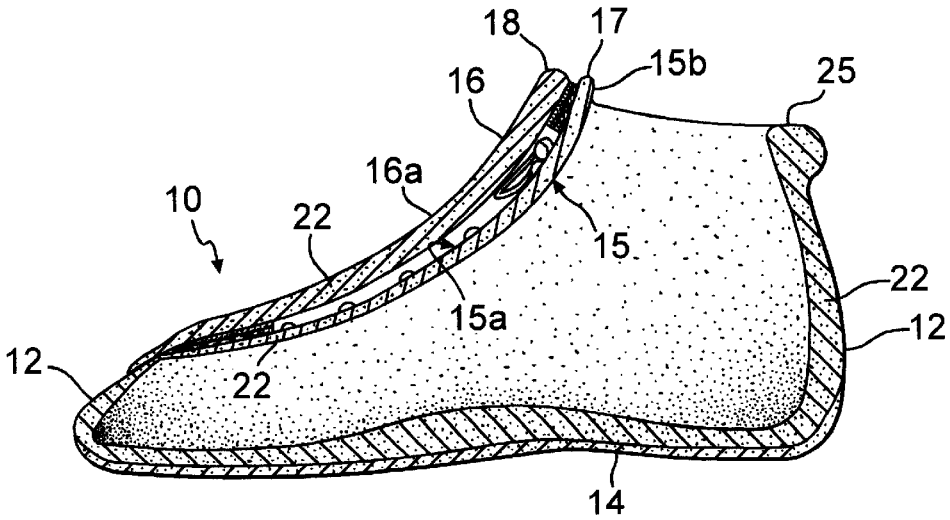
FIG. 2 is a cross-sectional view of the padded shoe in FIG. 1 taken along line 2—2.
Figure 3:
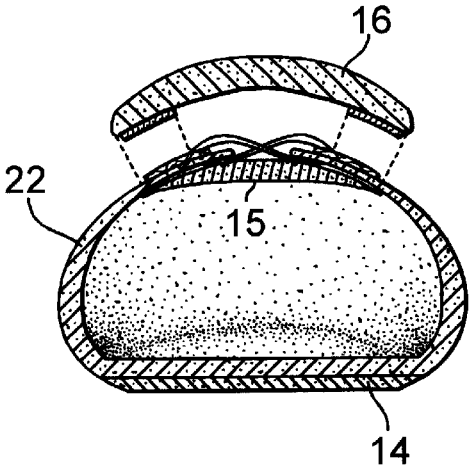
FIG. 3 is a cross-sectional view of the padded shoe in FIG. 1 taken along line 3—3.

As shown in FIGS. 2 and 3, the shoe upper 12 can include any suitable padding material 22 disposed therein. For example, the padding material 22 can be foam rubber, cotton, open-cell foam or closed-cell foam. The padding material 22 preferably has a high degree of resiliency and excellent shock absorption properties. In a particularly preferred embodiment, the padding material 22 is closed-cell chemically cross-linked polyethylene foam, such as the Minicell® products manufactured by the Voltek Division of the Sekisui America Corporation. Although not limited in this regard, closed-cell foam padded suitable for use in the shoe 10 can have a density of between approximately 1.5 and 3.5 pcf, a compression strength of between approximately 6 and 22 psi at approximately 25% deflection and between approximately 12 and 34 psi at approximately 50% deflection, and a tensile strength of between 30 and 120 psi.

The padding material 22 can be located throughout the shoe upper 12. In a particularly preferred embodiment, the padding material 22 has an increased thickness on those points of the shoe upper 12 which cover portions of the foot that are more likely to be injured during athletic activities involving kicking, such as kick boxing, martial arts, and soccer. For example, the padding material 22 can have an increased thickness at the portion of the shoe upper 12 that covers the forward dorsal region of the foot, the instep of the foot, the posterior aspect of the heel, the left and right forward lateral aspects of the foot, or the ankle portion. The ankle portion can be defined as the area which generally surrounds the medial malleoulus and the lateral malleous and the area therebetween. The padding material 22 can have any suitable thickness, but preferably has a thickness of between approximately 0.125 and 1.0 inches throughout the shoe 10, and most preferably has a thickness of between 0.25 and 0.5 inches.

Figure 4:
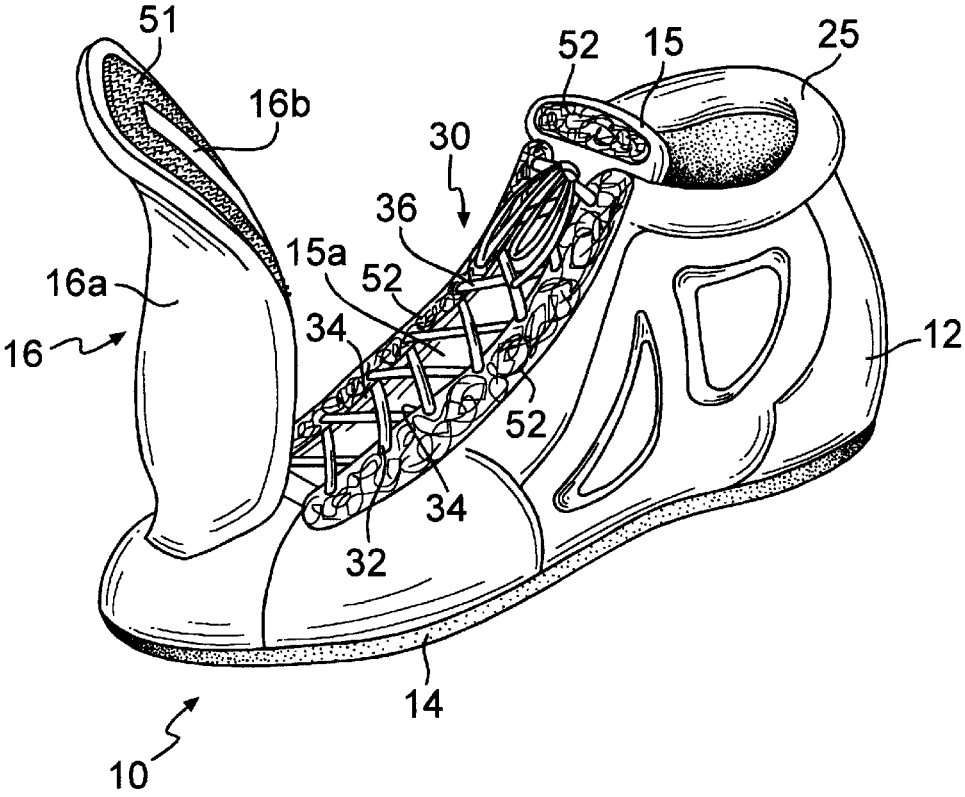
FIG. 4 is a perspective view of the padded shoe illustrated in FIG. 1 with the outer tongue portion shown in an outwardly extended position.

As can be seen in FIGS. 2–4, the padded tongue 18 preferably includes an inner tongue portion 15 and an outer tongue portion 16. The inner and outer tongue portions 15, 16 include front surfaces 15*a*, 15*b* and back surfaces 16*a*, 16*b*. As shown in FIG. 3, both the inner and outer tongue portions 15, 16 preferably have padding material 22. In a particularly preferred embodiment, the outer tongue portion 16 has a greater amount of padding material 22 than the inner tongue portion 15. Either the inner tongue portion 15 or the outer tongue portion 16, or both, can extend above the upper edges 25 of shoe upper 12. Extending the inner tongue portion 15 or the outer tongue portion 16 above the shoe upper 12 can advantageously provide protective padding for the lower leg of the wearer.

FIG. 4 illustrates the outer tongue portion 16 in an outwardly extended position. It can be seen that the shoe upper 12 includes oppositely disposed free edges 34. The free edges 34 are positioned between the inner and outer portions 15, 16 of the padded tongue 18.

Any suitable fastening structure can be utilized that will secure the shoe 10 to the foot of the wearer, such as Velcro®. The shoe 10 preferably includes a fastening structure that can be selectively tightenable to maintain the shoe on the wearer's foot. The fastening structure can interconnect the free edges 34 to secure the shoe 10 to the foot of the wearer. The fastening structure is preferably positioned between the inner and outer portions 15, 16 of tongue 18. The fastening structure can include a conventional lacing area 30 having a row of eyelets 32 located on each of the oppositely disposed edge portions 34 of the shoe upper 12. A lace 36 can be inserted through the eyelets 32.

The shoe 10 preferably includes an engagement structure to secure the outer tongue portion 16 to the inner tongue portion 15 and/or the shoe upper 12. The engagement structure can be formed of synthetic material portions 51, 52 which adhere when pressed together, such as Velcro®. The material portions are preferably affixed to the back surface 16*b* of outer tongue 16 and at least one of the front surface 15*a* of inner tongue portion 15 and the area proximate to the opposing edges 34 of the shoe upper 12. In the illustrated embodiment, fastening material portion 51 is attached to the periphery of the back surface 16*b* of outer tongue 16, although the invention is not limited in that regard. The fastening material portions 52 are attached to the shoe upper 12 proximate to the opposing edges 34 and on the front surface 15*a* of inner tongue portion 15 so as to be in general alignment with fastening material portion 51. The fastening material portions 51, 52 can be attached by any suitable method, such as stitching or adhesives, and can be arranged in any suitable configuration. Alternatively, metal snaps can be utilized to secure the outer tongue portion 16, either alone or in combination with hook and loop fastening material described above. Any suitable method, or combination of methods, can be used to secure the outer tongue portion 16 to prevent movement of the outer tongue portion 16 relative to the shoe upper 12 while the shoe 10 is being worn by the wearer.

Figure 5A:
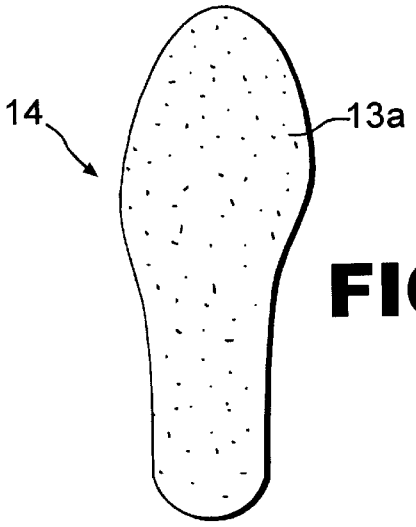
FIG. 5*a* is a bottom plan view of the padded shoe of FIG. 1 in which the lower surface of the sole is smooth.
Figure 5B:
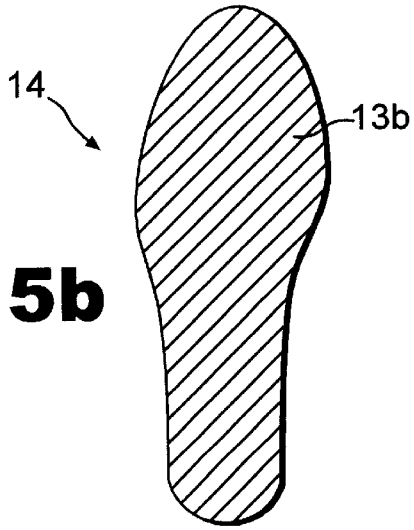
FIG. 5*b* is a bottom plan view of the padded shoe of FIG. 1 in which the lower surface of the sole is textured.
Figure 5C:
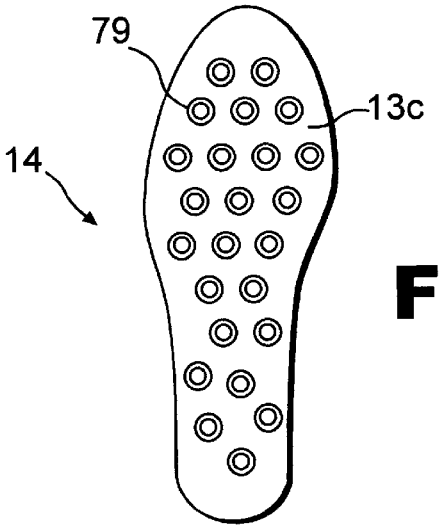
FIG. 5*c* is a bottom plan view of the padded shoe of FIG. 1 in which the lower surface of the sole includes a plurality of gripping protrusions.

The lower surface of sole 14 can have any suitable texture. FIGS. 5*a*, 5*b* and 5*c* illustrate various possible textures of the lower surface of sole 14, although the invention is not limited to the textures described or shown. FIG. 5*a* illustrates the lower surface 13*a* of the sole 14 having a smooth texture. The smooth texture allows the wearer to pivot on the balls of the feet on a flat surface, such as a gym floor, as would be done when practicing various marital arts sports. In sports such as kick boxing or karate, the bottom of the feet will strike the selected target, typically a kicking bag or a human opponent. Advantageously, the smooth texture of FIG. 5*a* is suitable for contact with both a floor surface and a human opponent or partner. In FIG. 5*b*, the lower surface 13*b* of the sole 14 is textured to provide a shoe 10 suitable for walking and running activities. FIG. 5*c* illustrates the lower surface of the sole 14 having a plurality of gripping protrusions 79 to provide a shoe 10. The embodiment shown in FIG. 5*c* is particularly suitable for use in outdoor field sports, such as soccer.

In a particularly preferred embodiment, the lower surface 13*a*, 13*b*, or 13*c* of the sole 14 is formed at least partly of crepe rubber. Advantageously, a crepe rubber sole is soft enough to reduce the likelihood of scraping or otherwise injuring a human opponent or partner who comes into contact with the sole, yet durable enough to allow the shoe to be worn on the street, as opposed to primarily on a gym floor.

As previously indicated, the shoe 10 provides advantages to the wearer when the wearer is engaged in activities which involve kicking, as the shoe 10 can have a limited number of protruding exterior features or sharp edges that could possibly injure an opponent. The padded tongue 18 provides protection to the top of the wearer's foot when this area is impacted, such as by kicking a bag or an opponent. The outer tongue portion 16 advantageously protects an opponent from impact with fastening structure, such as the knotted lace 36 of a preferred embodiment. The padding material in the inner tongue portion 15 further protects the top of the wearer's foot on impact from the lacing and knots in the lacing.

If the tongue of an athletic shoe slips to one side, the shoe can be uncomfortable for the wearer. The above-described arrangement of securing the outer tongue portion 16 to the inner tongue portion 15 and the shoe upper 12 also provides the advantage of maintaining the padded tongue 18 in an optimum center position, if desired.

Figure 6:
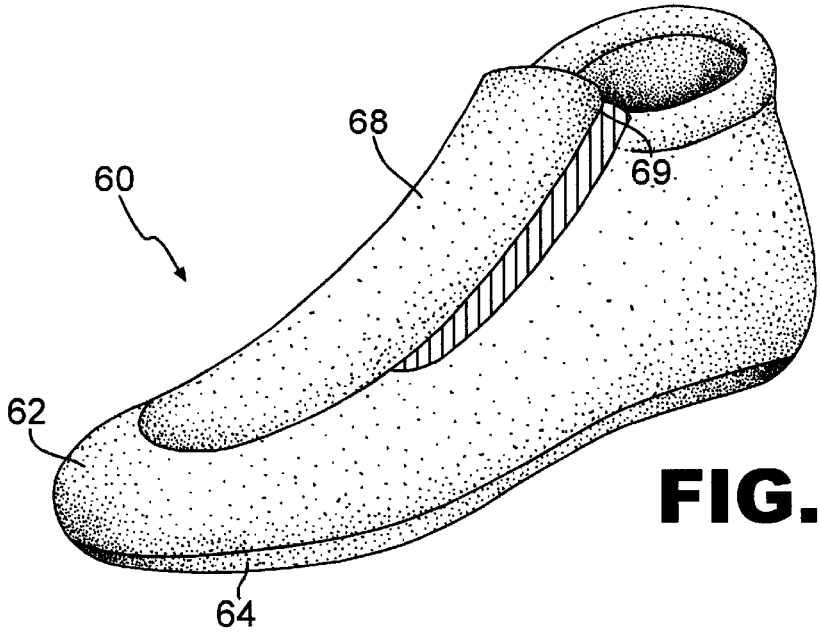
FIG. 6 is a perspective view of a padded shoe according to a second embodiment of the invention.
Figure 7:
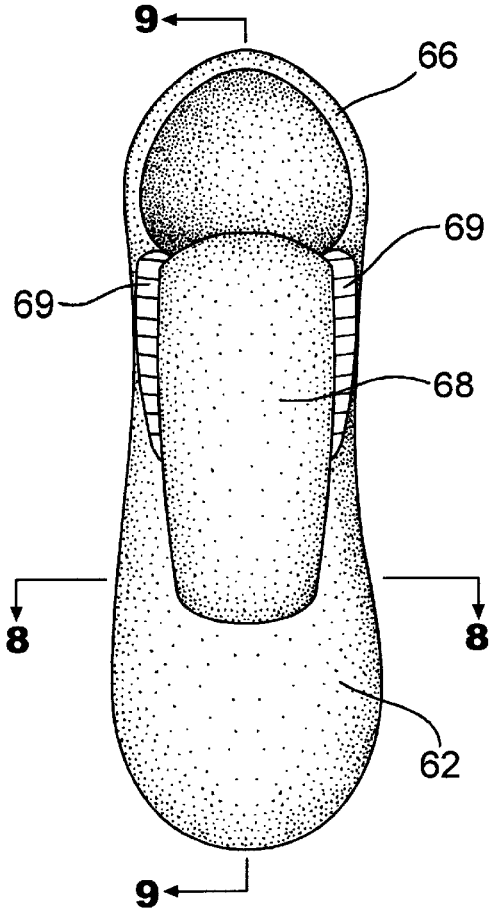
FIG. 7 is a top plan view of the padded shoe in FIG. 6.
Figure 8:
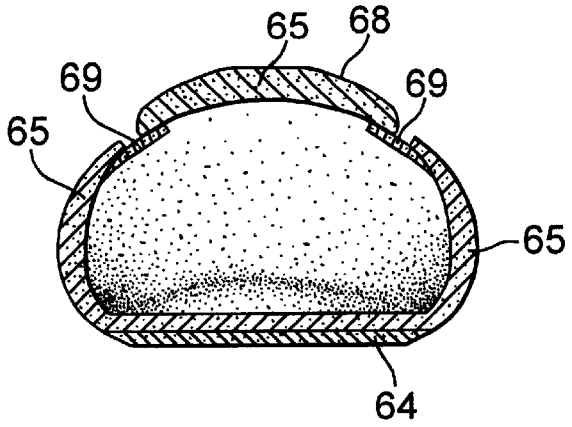
FIG. 8 is a cross-sectional view of the padded shoe in FIG. 6 taken along line 8—8.
Figure 9:
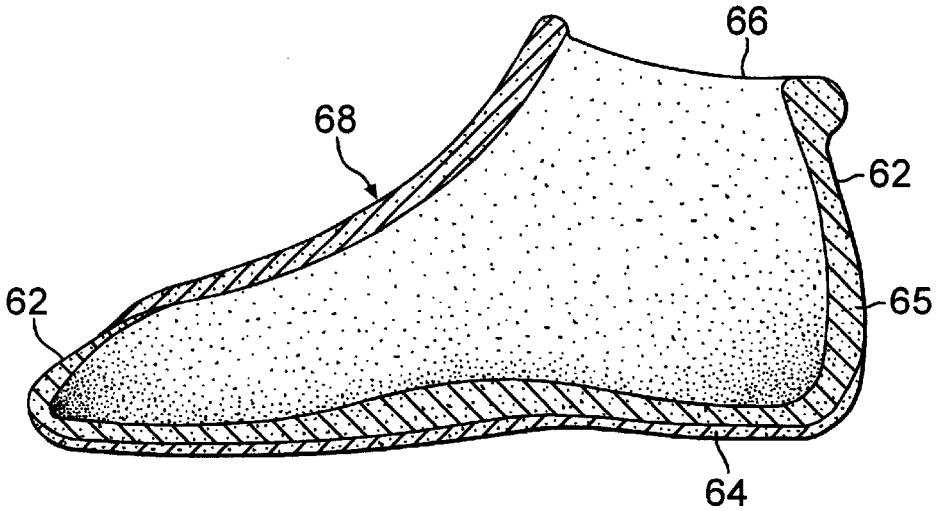
FIG. 9 is a cross-sectional view of the padded shoe in FIG. 6 taken along line 9—9.

A second embodiment of the padded shoe of the present invention is shown in FIGS. 6 and 7. The shoe 60 includes a shoe upper 62 adjoined to a sole 64. The shoe upper 62 can have any suitable configuration, including that which is shown in FIGS. 5 and 6, and that which is described in reference to the embodiment shown in FIG. 1. The lower surface of sole 64 can have any suitable texture, such as those described in FIGS. 5*a–c* in connection with the embodiment shown in FIG. 1. At least a portion of the perimeter of the sole 64 can be chamfered to provide a smooth arcuate edge. The shoe upper 62 includes upper edges 66 which can form a collar into which a foot can be inserted. As shown in FIGS. 8 and 9, the shoe upper 62 includes padding material 65 disposed therein which is located throughout the shoe upper 62. The padding material 65 can have varying thicknesses throughout the shoe upper 62, and can be distributed to provide protection to the areas of the foot that can be subjected to impact due to kicking maneuvers or other activities placing stress on the foot, as was described above in connection with the shoe 10 shown in FIG. 1. The shoe 60 includes a padded tongue 68 which serves to protect the top of the wearer's foot. The padded tongue 68 can have any suitable shape. The lower end of padded tongue 68 is preferably fixedly attached to the shoe upper 62 and preferably has an upper end extending at least to the upper edge 66 of shoe upper 62, although the invention is not limited in that regard.

The shoe 60 can have any suitable resilient material which can closely surround the foot of the wearer. For example, the shoe 60 can include elongate portions of resilient material 69 longitudinally positioned on the shoe 60. The illustrated embodiment includes two portions of resilient material 69. Each portion of resilient material 69 has a first edge preferably fixedly attached to at least a portion of the side edge of the padded tongue 68 and a second edge preferably attached to the shoe upper 62. The padded tongue 68 can be outwardly distended from the shoe upper 62 by stretching the resilient portion 69 in order to allow insertion of the wearer's foot.

Figure 10:
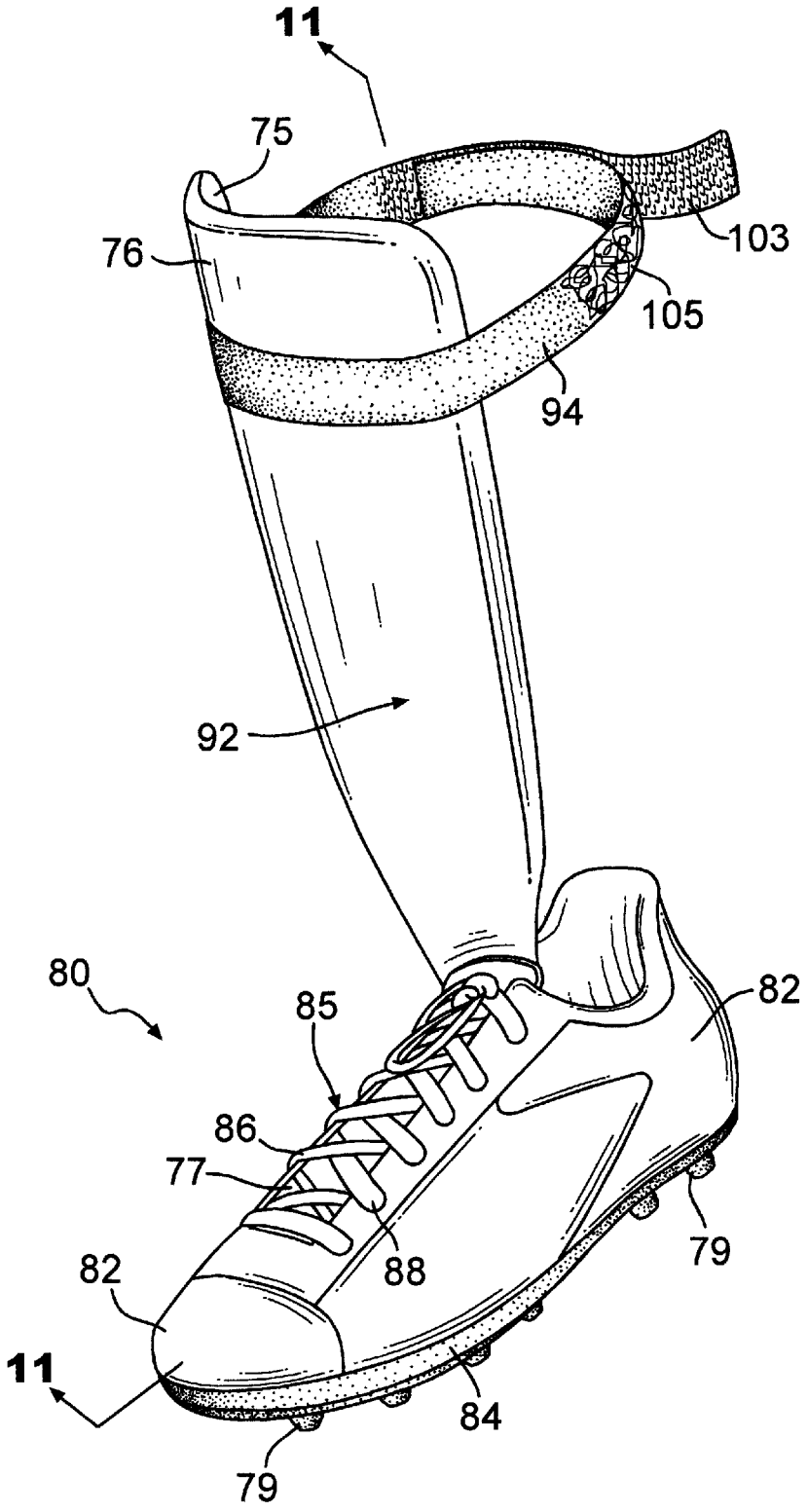
FIG. 10 is a perspective view of a padded shoe according to a third embodiment of the invention.

A third embodiment of the shoe of the present invention is shown in FIG. 10. The shoe 80 includes a shoe upper 82 adjoined to a sole 84. The shoe upper 82 includes a padded tongue 77 which has a lower end connected to the shoe upper 82 and a free upper end 77*a*, shown most clearly in FIGS. 11 and 12. The sole 84 can have any texture on the lower surface, however the sole 84 preferably includes a plurality of gripping agents 79, as previously discussed and shown in FIG. 5*c*. The shoe upper 82 can have any suitable configuration. The shoe upper 82 preferably includes a fastening structure 85. In the illustrated embodiment, the fastening structure 85 includes a conventional lacing arrangement having two rows of oppositely disposed eyelets 88, and a lace 86 threaded through the eyelets 88 and tied in a conventional fashion.

Figure 11:
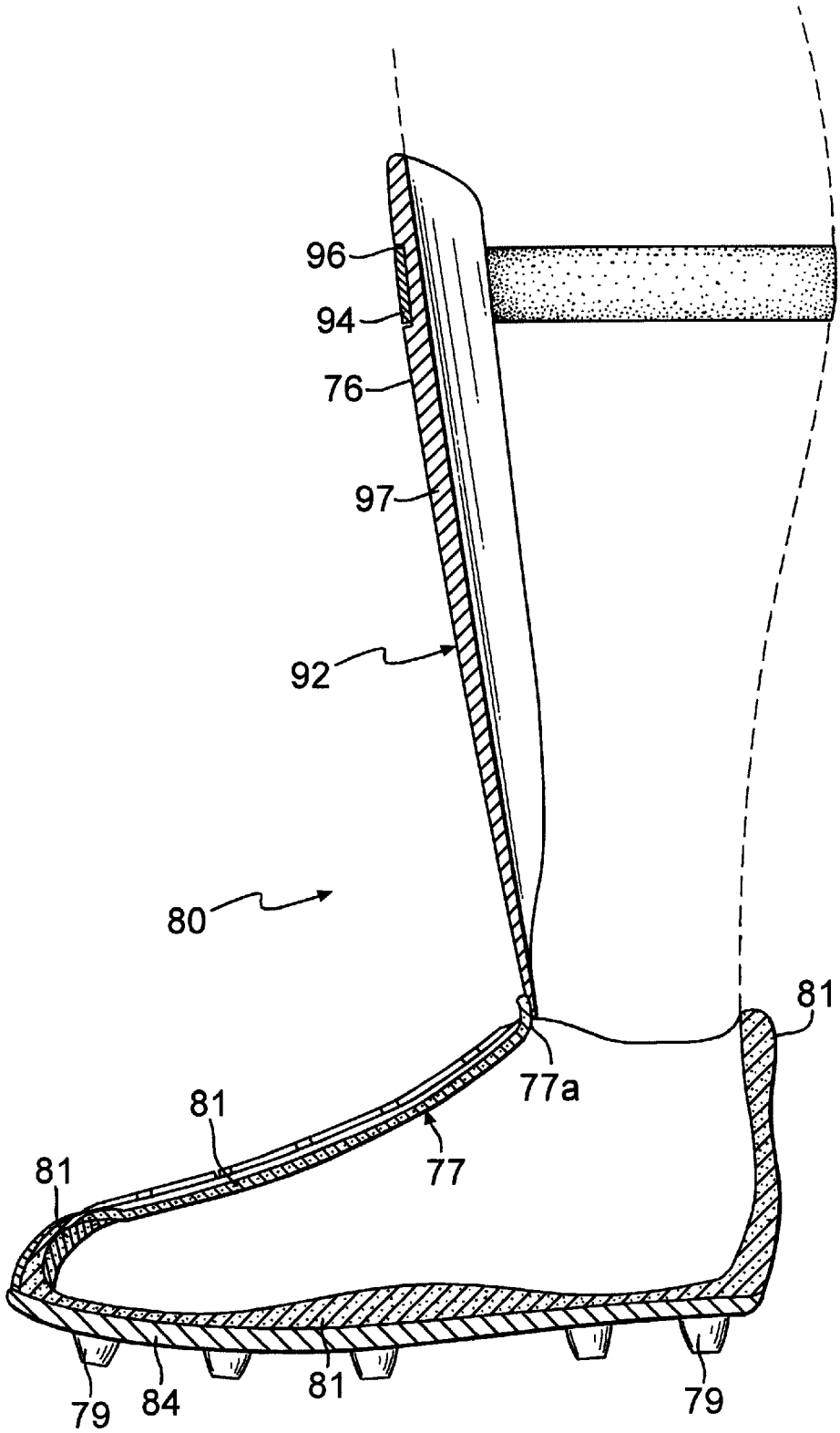
FIG. 11 is a partial cross-sectional view of the padded shoe in FIG. 10 taken along line 11—11.

As shown in FIG. 11, padding material 81 is located throughout the shoe upper 82. The padding material 81 can be any suitable material, as described above in reference to the embodiments of FIGS. 1 and 6. Preferably, the padding material is closed-cell foam material, although it can be any padding material known in the art. The padding material 81 can have a greater thickness on those points of the shoe upper 82 which cover the foot of the wearer at points of possible impact, as in the embodiments shown in FIGS. 1 and 6.

Referring again to FIG. 10, the shoe 80 preferably includes a shin guard 92 extending upward from the shoe upper 82 so as to be in contact with and substantially cover the shin of the wearer. The shin guard 92 is preferably configured to closely engage with the shin of the wearer, and can include a convex surface 75 and a concave surface 76. The shin guard 92 is preferably detachably connected to any suitable portion of the shoe upper 82 and, in the illustrated embodiment, is detachably connected to padded tongue 77. The shin guard 92 can be constructed of any suitable material, such as leather, canvas, or plastic. The shin guard 92 preferably includes padding material 97. The padding material 97 can be any suitable padding material, such as closed cell foam rubber, and should preferably have a sufficient hardness and density to maintain the shape of the elongate member 92 without significant distortion.

Figure 12:
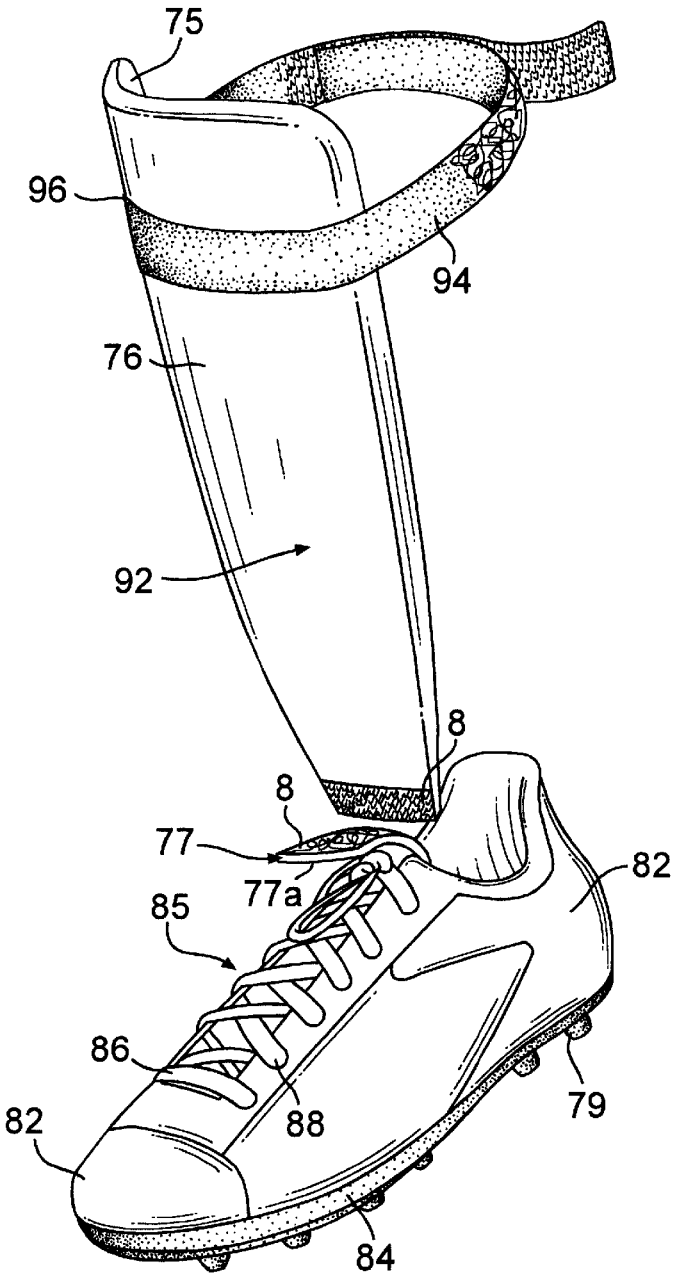
FIG. 12 is a perspective view of the padded shoe in FIG. 10 with the shin guard shown detached from the tongue.
Figure 13:
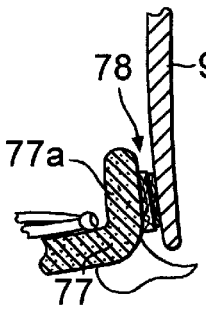
FIG. 13 is a detailed view of the embodiment shown in FIG. 10 showing the use of mated snaps to secure the shin guard to the tongue.

The invention contemplates a variety of structures which can be utilized to secure the shin guard 92 to the padded tongue 77. FIG. 12 illustrates the shin guard 92 partially detached from the padded tongue 77. In the illustrated embodiment, synthetic material portions 87, 89 which adhere when pressed together, such as Velcro®, are affixed to aligning surfaces of the shin guard 92 and padded tongue 77 so that the shin guard can extend generally vertically upward from the shoe 80. The shin guard 92 can also be secured to padded tongue 77 using mated snaps 78, as shown in FIG. 13.

Referring again to FIGS. 10 and 11, the shin guard 92 can include at least one strap 94 which secures the shin guard 92 to the leg of the wearer. The strap 94 can be a single piece, as illustrated, or can consist of separate portions attached to the sides of the shin guard 92. The strap 94 can also extend laterally through shin guard 92. The strap 94 preferably includes a fastening structure to secure the strap 94 either to itself or to the shin guard 92. The fastening structure should preferably allow the strap 94 to be selectively adjustable to appropriately fit the leg of the wearer. In the illustrated embodiment, the opposite ends of strap 94 include mated portions fastening material 103, 105, such as Velcro®, attached to the front and back surfaces of the strap 94. Any suitable securement method can be used to secure the shin guard 92 to the leg of the wearer.

As is shown in FIG. 11, the front surface 76 can include a recess 96 which is approximately the same width as the strap 94. The strap 94 can be seated in the recess 96, and is preferably adhered or otherwise attached. The recess 94 preferably has a depth approximately equal to the thickness of the strap 94, so that when strap 94 is seated in the recess 97, the surface of strap 94 is in approximate alignment with the front surface 76 of the shin guard 92.

It should be understood that the examples and embodiments described herein are for illustrative purposes only and that various modifications or changes in light thereof will be obvious to persons skilled in the art, and that such modifications or changes are to be included within the spirit and purview of this application. Moreover, the invention can take other specific forms without departing from the spirit or essential attributes thereof.

What is claimed is:

1. A padded shoe, comprising:

a shoe upper adjoined to a sole, said shoe upper having padding material therein whereby the wearer can strike a target with said padded upper of said shoe and the wearer and target are protected from direct impact;

a padded tongue, said padded tongue having an inner padded tongue portion and an outer padded tongue portion, said inner and outer tongue portions each having a lower end attached to said shoe upper and a free upper end;

engagement structure on an underside of said outer tongue to secure said outer tongue portion to at least one of said inner tongue portion and said shoe upper; and fastening structure disposed between said inner and outer tongue portions, said fastening structure being tightenable to maintain said shoe on a foot of a wearer of said shoe, whereby the wearer can strike a target with said padded tongue of said shoe and the target and the wearer are protected from direct impact with said fastening structure and said engagement structure.

2. The shoe of claim 1, wherein said padding material comprises closed-cell foam padding.

3. The shoe of claim 1, wherein said padding material is positioned within said shoe upper to generally correspond to at least one location on the foot of the wearer, said location including at least one of the group consisting of the forward dorsal region, the instep, the posterior aspect of the heel, the left and right forward lateral aspects of the foot, and the ankle portion.

4. The shoe of claim 1, wherein said sole has a smooth lower surface.

5. The shoe of claim 1, wherein said sole has a textured lower surface.

6. The shoe of claim 1, wherein said sole has a plurality of gripping protrusions.

7. The shoe of claim 1, further wherein at least a portion of the perimeter of said sole is chamfered.

8. The shoe of claim 7, wherein said chamfering provides a smooth arcuate edge to said sole.

9. The shoe of claim 1, wherein said sole is formed at least partially from crepe rubber.

10. The shoe of claim 1, wherein said fastening structure comprises a lace threaded through oppositely disposed eyelets.

11. The shoe of claim 1, wherein said engagement structure comprises mated portions of fastening material.

12. The shoe of claim 1, wherein said engagement structure comprises mated snaps.

13. The shoe of claim 1, wherein said padded tongue extends above said shoe upper.

14. A padded shoe as in claim 1, wherein said padding material in said shoe upper is positioned within said shoe upper to generally correspond to at least one location on the foot of the wearer, said locations including at least one of the group consisting of the forward dorsal region, the instep, the lateral and posterior aspects of the heel, the left and right forward lateral aspects of the foot, and the ankle portion.

15. The shoe of claim 14, further comprising a plurality of gripping protrusions extending outwardly from said sole.

16. The shoe of claim 14, wherein said sole has a smooth lower surface.

17. The shoe of claim 14, wherein said sole has a textured lower surface.

18. The shoe of claim 14, further wherein at least a portion of the perimeter of said sole is chamfered.

19. The shoe of claim 14, wherein said sole is formed at least partially from crepe rubber.

20. The shoe of claim 14, wherein said padding material comprises closed-cell foam padding.

21. The shoe of claim 1, wherein said padding material in said shoe upper is located throughout said shoe upper.

* * * * *